US010352264B2

(12) United States Patent
Mukaihara et al.

(10) Patent No.: US 10,352,264 B2
(45) Date of Patent: Jul. 16, 2019

(54) FUEL INJECTOR CONTROL DEVICE

(71) Applicant: Hitachi Automotive Systems, Ltd., Hitachinaka-shi, Ibaraki (JP)

(72) Inventors: Osamu Mukaihara, Hitachinaka (JP); Masahiro Toyohara, Hitachinaka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 0 days.

(21) Appl. No.: 15/740,670

(22) PCT Filed: Jun. 29, 2016

(86) PCT No.: PCT/JP2016/069195
§ 371 (c)(1),
(2) Date: Dec. 28, 2017

(87) PCT Pub. No.: WO2017/006814
PCT Pub. Date: Jan. 12, 2017

(65) Prior Publication Data

US 2018/0195450 A1 Jul. 12, 2018

(30) Foreign Application Priority Data

Jul. 9, 2015 (JP) ..... 2015-137388

(51) Int. Cl.
*F02D 41/06* (2006.01)
*F02M 51/00* (2006.01)
(Continued)

(52) U.S. Cl.
CPC ..... *F02D 41/061* (2013.01); *F02D 41/20* (2013.01); *F02D 41/2448* (2013.01);
(Continued)

(58) Field of Classification Search
CPC ..... F02D 45/00; F02M 51/00; F02M 51/06; F02M 51/0675; F02M 65/00; F02M 65/005
(Continued)

(56) References Cited

U.S. PATENT DOCUMENTS

2007/0251492 A1* 11/2007 Beilharz ..... F02D 41/2096 123/339.14
2009/0301439 A1* 12/2009 Suzuki ..... F02D 41/2464 123/458
(Continued)

FOREIGN PATENT DOCUMENTS

DE 10 2008 000 587 A1 10/2008
DE 10 2008 041 576 A1 4/2009
(Continued)

OTHER PUBLICATIONS

International Search Report (PCT/ISA/210) issued in PCT Application No. PCT/JP2016/069195 dated Sep. 20, 2016 with English-language translation (five (5) pages).
(Continued)

*Primary Examiner* — Hung Q Nguyen
*Assistant Examiner* — Johnny H Hoang
(74) *Attorney, Agent, or Firm* — Crowell & Moring LLP

(57) ABSTRACT

Since a factor affecting an individual difference learning result is reduced or eliminated regardless of a valve body behavior, it is possible to highly accurately detect an individual difference of a fuel injector caused by the valve body behavior and to reliably detect the individual difference even when the fuel injector is replaced. When a valve opening/closing timing of the fuel injector is learned by a learning unit, a unit of interrupting the learning if a predetermined condition is established, a unit of prohibiting the learning of the valve closing timing using the learning unit if a prede-
(Continued)

termined condition is established, or a unit of prohibiting the learning of the valve opening/closing timing of the fuel injector using the learning unit if a fuel pressure of a common rail supplying a fuel to the plurality of fuel injectors changes by a predetermined value or more within a predetermined time is provided.

15 Claims, 8 Drawing Sheets

(51) Int. Cl.

| | |
|---|---|
| ***F02D 45/00*** | (2006.01) |
| ***F02M 65/00*** | (2006.01) |
| ***F02D 41/20*** | (2006.01) |
| ***F02D 41/24*** | (2006.01) |
| ***F02D 41/34*** | (2006.01) |
| ***F02M 51/06*** | (2006.01) |
| *F02D 41/40* | (2006.01) |

(52) U.S. Cl.
CPC ..... *F02D 41/2467* (2013.01); *F02D 41/345* (2013.01); *F02D 45/00* (2013.01); *F02M 51/00* (2013.01); *F02M 51/0675* (2013.01); *F02M 65/00* (2013.01); *F02M 65/005* (2013.01); *F02D 41/401* (2013.01); *F02D 2041/2003* (2013.01); *F02D 2041/2055* (2013.01); *F02D 2041/2058* (2013.01)

(58) Field of Classification Search
USPC ..... 123/445, 472, 478–480, 490; 701/102–105
See application file for complete search history.

(56) References Cited

U.S. PATENT DOCUMENTS

| | | | | |
|---|---|---|---|---|
| 2012/0116654 | A1* | 5/2012 | Toyohara | F02D 41/247 701/104 |
| 2013/0112278 | A1* | 5/2013 | Chen | E03C 1/055 137/2 |
| 2015/0377176 | A1 | 12/2015 | Hatanaka et al. | |
| 2017/0002765 | A1* | 1/2017 | Nakano | F02D 41/34 |
| 2017/0306877 | A1* | 10/2017 | Ahn | F02D 41/2467 |

FOREIGN PATENT DOCUMENTS

| | | | |
|---|---|---|---|
| EP | 1 308 616 | A2 | 5/2003 |
| JP | 2013-185548 | A | 9/2013 |
| JP | 2014-152697 | A | 8/2014 |
| JP | 2016-33343 | A | 3/2016 |
| WO | WO 2013/132300 | A2 | 9/2013 |
| WO | WO 2014/181166 | A2 | 11/2014 |
| WO | WO 2014/207523 | A2 | 12/2014 |

OTHER PUBLICATIONS

Japanese-language Written Opinion (PCT/ISA/237) issued in PCT/JP2016/069195 dated Sep. 20, 2016 (four (4) pages).
Japanese-language Office Action issued in counterpart Japanese Application No. 2017-527407 dated Oct. 23, 2018 with English translation (six (6) pages).
Extended European Search Report issued in counterpart European Application No. 16821283.5 dated Feb. 1, 2019 (seven pages).

* cited by examiner

FUEL INJECTOR CONTROL DEVICE

TECHNICAL FIELD

The present invention relates to a fuel injector control device for a cylinder direct injection internal combustion engine that directly injects a fuel into a cylinder.

BACKGROUND ART

In recent years, a demand for a fuel injector used in an internal combustion engine becomes strict due to a strengthened exhaust regulation. Particularly, there is a high interest for expanding a use area and many companies are developing a half lift control capable of improving a minimum injection amount while satisfying a static flow requirement in the past.

The half lift control executes a highly accurate control in a state (hereinafter, referred to as a half lift region) before a valve body provided in the fuel injector completely reaches a valve opening position (hereinafter, a full lift), but a change in injection amount of the half lift region increases due to an individual difference of the fuel injector.

For this reason, various techniques for detecting the individual difference of each fuel injector are proposed. For example, Japanese Patent Application Laid-Open No. 2014-152697 discloses a technique for indirectly detecting the individual difference of the fuel injector, considering a valve opening operation (specifically, a timing in which the valve body opens the valve) of the fuel injector as electric characteristics. Similarly, a valve closing operation of the fuel injector is also detected from the electric characteristics in the known techniques.

CITATION LIST

Patent Literature

PTL 1: Japanese Patent Application Laid-Open No. 2014-152697

SUMMARY OF INVENTION

Technical Problem

However, the above-described detection technique (hereinafter, referred to as learning) only describes a method of improving the detection performance (ease of detection). For this reason, there is a need to improve the detection accuracy (a deviation from a true value) in a case where the individual difference of the fuel injector is actually detected.

As a method with the highest detection accuracy, a method of directly monitoring the valve body behavior of the fuel injector can be exemplified. However, in this method, there is a need to provide a sensor capable of detecting the stroke of the valve body in the fuel injector or the casing distortion of the fuel injector. As a result, a problem arises in that the cost of the fuel injector increases.

Further, also in the method of indirectly detecting the valve body behavior represented by the cited document above, it is difficult to extract only the individual difference of the fuel injector. Accordingly, there is concern that an erroneous detection result can be calculated by a factor not caused by the valve body behavior.

Solution to Problem

In order to solve the above-described problems, the invention has the following means. When a valve opening/closing timing of a fuel injector is learned by a learning unit, a unit of interrupting the learning if a predetermined condition is established, a unit of prohibiting the learning of the valve closing timing using the learning unit if a predetermined condition is established, or a unit of prohibiting the learning of the valve opening/closing timing of the fuel injector using the learning unit if a fuel pressure of a common rail supplying a fuel to a plurality of fuel injectors changes by a predetermined value or more within a predetermined time is provided.

Advantageous Effects of Invention

According to the invention, since the factors affecting the individual difference learning result are reduced or eliminated regardless of the valve body behavior, it is possible to highly accurately detect the individual difference of the fuel injector caused by the valve body behavior and to reliably detect the individual difference even when the fuel injector is replaced.

DESCRIPTION OF EMBODIMENTS

Hereinafter, embodiments of the invention will be described with reference to the drawings.

First Embodiment

Figure 1:
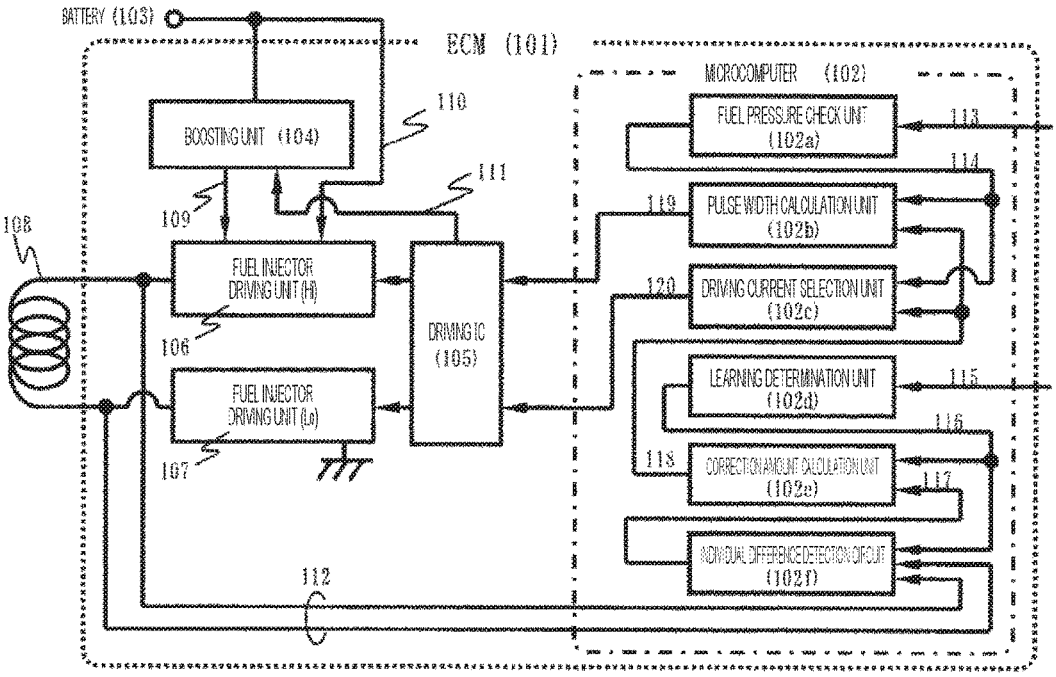
FIG. 1 illustrates a basic configuration example of a fuel injection valve control device.

FIG. 1 illustrates a basic configuration example of a fuel injection valve control device of the invention. The fuel injection valve control device is provided in an ECM (Engine Control Module: 101) and a battery voltage (110) supplied from a battery (103) is supplied to an ECM (101) via a fuse (not illustrated) and a relay (not illustrated).

Based on an instruction from a driving IC (105), a boosting unit (104) boosts the battery voltage (110) to a predetermined target voltage. When a high voltage (109) generated in this way is applied at the time of starting an operation of a fuel injection valve (108), a valve body in the fuel injection valve (108) can obtain a valve opening force overcoming a strong valve closing force generated by a high fuel pressure.

Further, a driving time (a pulse signal: 119) of the fuel injection valve (108) is calculated by a pulse width calculation unit (102*b*) provided in a microcomputer (102), a driving current setting value (120) of the fuel injection valve (108) is determined by a driving current selection unit (102*c*), and the driving current setting value is output to the driving IC (105). The driving IC (105) executes a so-called current control by controlling a fuel injection valve driving unit (106, 107) on the basis of such information and a predetermined control procedure set in advance. In addition, a detailed description of the fuel injection valve driving unit (106, 107) will be made below with reference to FIG. 2.

The width (the driving time) of the pulse signal (119) of the fuel injection valve (108) and the driving current setting value (120) are calculated inside the microcomputer (102).

Specifically, a description will be made with reference to FIG. 3, but a fuel pressure in the vicinity of the fuel injection valve (108) is measured by using a fuel pressure sensor (not illustrated) attached to a predetermined position from the downstream side of a high pressure fuel pump (not illustrated) to the fuel injection valve (108). An output voltage of the fuel pressure sensor (not illustrated) is converted into a fuel pressure value in a fuel pressure check unit (102*a*), the pulse signal (119) is corrected by the pulse width calculation unit (102*b*) on the basis of the fuel pressure value (114), and the driving current setting value (120) is determined by the driving current selection unit (102*c*).

Further, an individual difference detection function of the fuel injection valve (108) is provided in the microcomputer (102). The individual difference detection function is realized by an individual difference learning determination unit (102*d*) which determines whether to execute individual difference learning, an individual difference detection circuit (102*f*) which detects an individual difference of the fuel injection valve (108) on the basis of signals (112) of driving currents or driving voltages from the fuel injection valve (108), and a correction amount calculation unit (102*e*) which calculates a correction amount of the fuel injection valve (108) for each cylinder on the basis of individual difference information (117) for each cylinder detected by the individual difference detection circuit.

Further, the individual difference learning determination unit (102*d*) determines whether to execute the individual difference learning of the fuel injection valve (108) on the basis of a permission determination from a learning permission determination unit (not illustrated) provided at a precedent stage or other information (to be described later) and controls the operations of an individual difference detection circuit (102*f*) and a correction amount calculation unit (102*e*) on the basis of the result (116).

Figure 2:
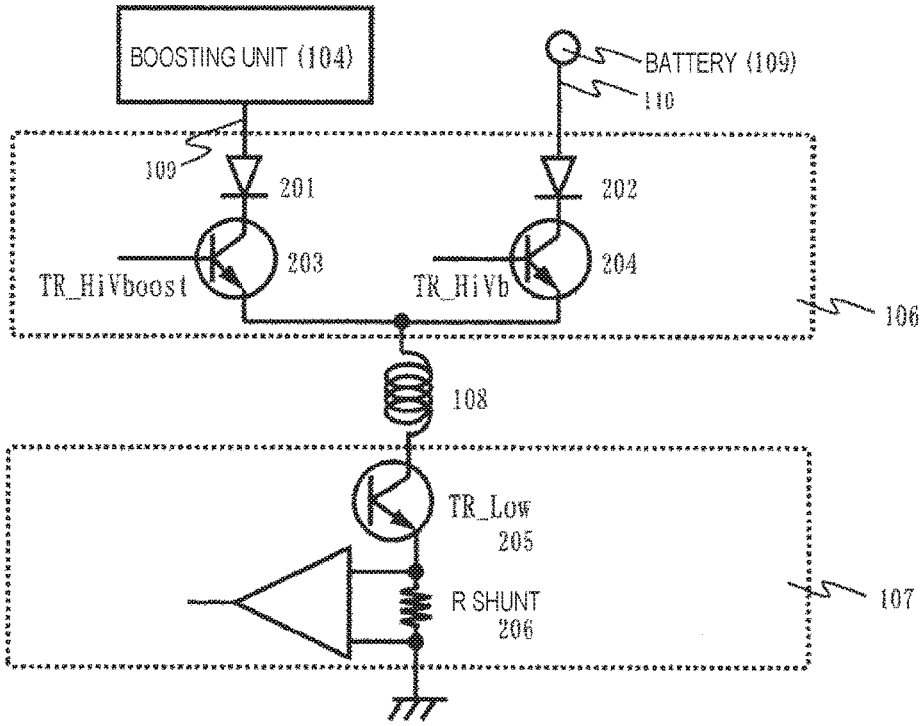
FIG. 2 is a configuration diagram of a fuel injection valve driving unit.

Next, a detailed description of the driving unit (106, 107) of the fuel injector (108) illustrated in FIG. 1 will be made in FIG. 2.

As illustrated in FIG. 1, in order to supply a current necessary for opening the valve of the fuel injector (108), the driving unit (106) at the upstream side of the fuel injector (108) supplies the high voltage (109) generated by the boosting unit (104) to the fuel injector (108) by using a circuit of a TR_Hivboost (203) in the drawing via a diode (201) provided for preventing a reverse flow of a current. Meanwhile, the battery voltage (110) necessary for maintaining the valve body of the fuel injector (108) in a valve opened state after the valve of the fuel injector (108) is opened is supplied to the fuel injector (108) by using a circuit of a TR_Hivb (204) in the drawing via a diode (202) for preventing a reverse flow of a current similarly to the high voltage (109).

Next, the fuel injector driving unit (107) at the downstream side of the fuel injector (108) is provided with a TR_Low (205). When the driving circuit TR_Low (205) is turned on, a power voltage (109 or 110) can be applied from the fuel injector driving unit (106) at the upstream side of the fuel injector (108) to the fuel injector (108). Further, a shunt resistor (206) is provided at the downstream side of the TR_Low (205). When a current consumed by the fuel injector (108) is detected, a desired current control of the fuel injector (108) can be executed. In addition, this description illustrates an example of a method of driving the fuel injector (108). For example, when the fuel pressure is relatively low, there is a method of using the battery voltage (110) instead of the high voltage (109) at the time of opening the valve of the fuel injector (108).

Next, a learning process will be described with reference to FIG. 3. First, Reference Numeral 307 in the drawing indicates a predetermined reference position. On the assumption that one combustion cycle is set from a predetermined reference position to a next predetermined reference position, this cycle is expressed as 720 deg CA in terms of a crank angle. A learning execution flag (301) is turned on when a learning execution condition of the fuel injector (108) is established and is turned off when the condition is not established. Reference Numerals 302 to 305 indicate pulse signals for the fuel injectors (108) of cylinders and each cylinder executes a single injection operation during one combustion cycle.

Although the learning execution flag is turned on at T306 which is a time point when the learning execution condition is established, the learning procedure is not executed naturally for 302*a* which is a previous injection operation. However, in this drawing, a learning process is executed from the injection operation (302*b*) of the predetermined cylinder (CYL. 1: 302 in this drawing) after the learning execution flag (301) is turned on. In addition, since this drawing is an embodiment, the learning may be executed as soon as the learning procedure is ready (for example, first 303*a*) from the time point (T306) when the learning execution flag (301) is turned on.

In this drawing, since the number of times of learning for each cylinder is set to two times, the learning process is executed from the operation states of 302*b* and 302*c* in the fuel injector of CYL. 1. Next, the learning process is executed from the injection operations of 303*c*→303*d*→304*d*→304*e*→305*e*→305*f* according to a combustion procedure.

Also in the learning procedure, only one example is illustrated. For example, when the learning is supposed to be executed according to a predetermined order like 302*c*→303*c*→304*c*→305*c*→302*d*→303*d*→304*d*→305*d*, the procedure is repeated on the basis of the number of times of learning for each set cylinder. Accordingly, the same effect of the invention can be exhibited.

Next, a first embodiment of the invention will be described with reference to FIG. 4.

Figure 4:
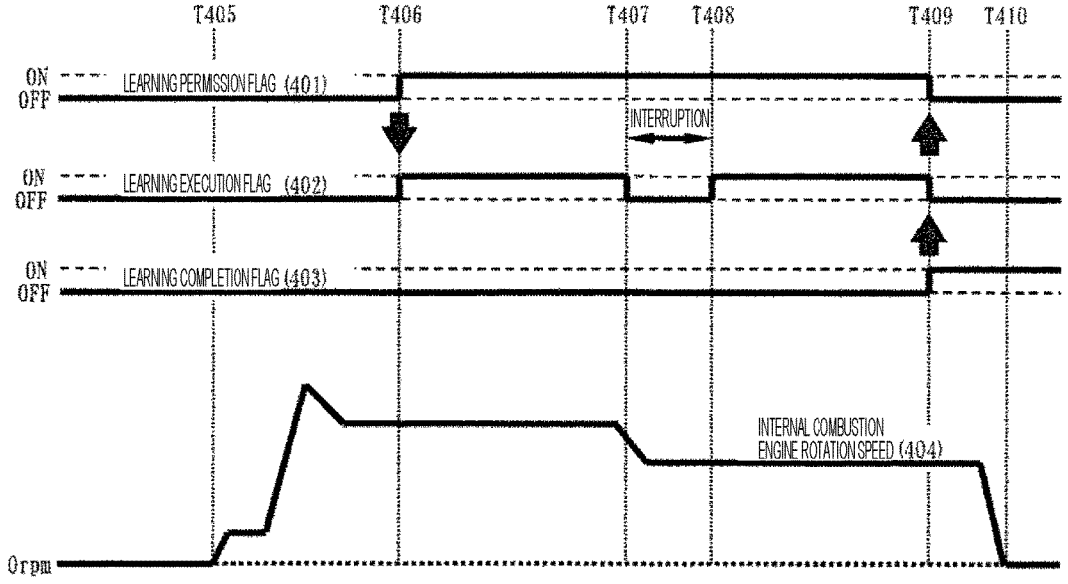
FIG. 4 is an embodiment of the invention.

From above, FIG. 4 illustrates a learning permission flag (401) which determines whether to execute learning, a learning execution flag (402), a learning completion flag (403) which is turned on when the learning process is completed, and an internal combustion engine rotation speed (404).

First, the internal combustion engine rotation speed becomes stabilized after the internal combustion engine is started from T405. Next, when the learning permission condition is established, the learning permission flag is turned on (T406). In this drawing, an example in which the learning execution flag (402) is turned on at the same time in which the learning permission flag is turned on has been described, but there is no need to say that both establishment conditions are the same.

Figure 3:
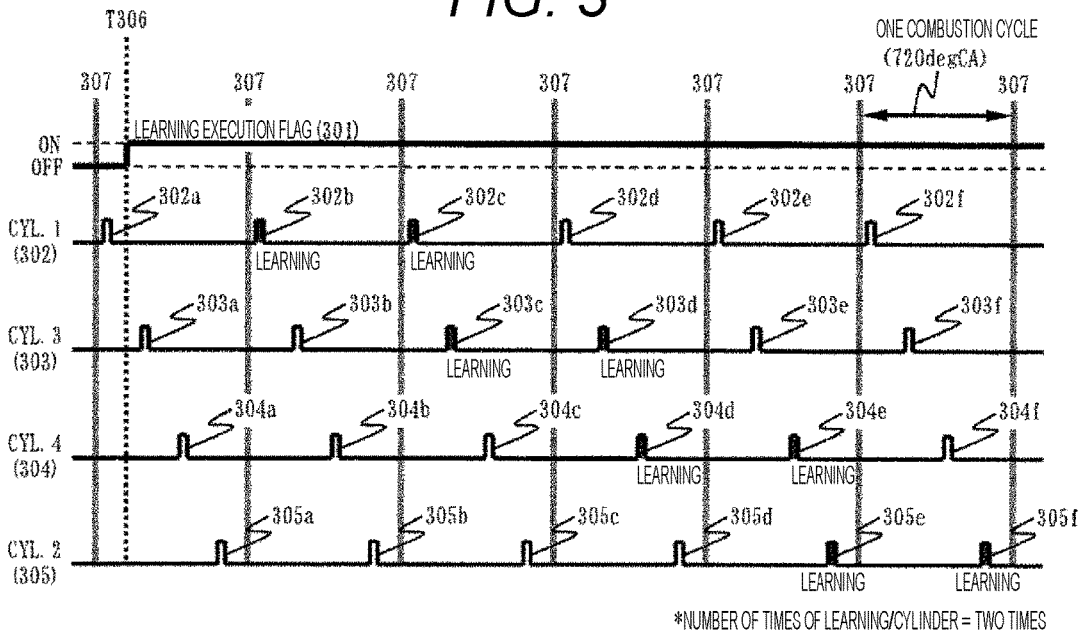
FIG. 3 is an explanatory diagram of a learning procedure.

During a period in which the learning execution (402) is turned on, the learning process is executed according to the predetermined learning procedure described in FIG. 3. However, since the learning execution condition is not established at T407, only the learning execution flag (402) is turned off and the learning process is interrupted. Next, when the learning execution flag (402) is turned on after the learning permission condition is established again, the learning is resumed from (T408) and the learning procedure is completed at T409. When the learning procedure is completed, the learning completion flag (403) is turned on. Then, the learning execution flag (402) and the learning permission flag (401) are turned off and this state is continued until T410 in which the internal combustion engine is stopped.

Here, as a feature of this embodiment, the learning is interrupted when the learning execution condition is not established. For example, regarding a condition specifying a learning scene such as an operation mode of an internal combustion engine (a state telling whether a homogeneous combustion is executed or not or a state telling whether a stratified combustion is executed or not) or an operation region (a region in which an internal combustion engine rotation speed is within a predetermined range or a load is within a predetermined range), the learning execution condition is set as a condition for eliminating a factor that makes the valve body behavior of the fuel injector unstable. For example, the learning execution flag (402) is turned on if it is determined that the driving current profile for learning is established when the driving current profile is divided into a learning dedicated case and an ordinary case and the learning execution flag (402) is turned off if it is determined that the driving current profile for learning is not established. In this way, an interruption during learning can be executed.

As described above, in this embodiment, the fuel injector control device (ECM) controlling the fuel injectors includes the learning unit that learns the valve opening/closing timing of the fuel injector on the basis of the driving voltage applied to the fuel injector or the driving current flowing to the fuel injector. Then, in a case where the valve opening/closing timing of the fuel injector is learned by the learning unit, the learning is interrupted when a predetermined condition is established.

Further, the control device (ECM) prohibits the learning of the valve closing timing using the learning unit when a predetermined condition is established. Further, the control device (ECM) prohibits the learning of the valve opening/closing timing of the fuel injector using the learning unit when the fuel pressure of the common rail supplying a fuel to the fuel injectors changes by a predetermined value or more within a predetermined time.

Second Embodiment

Next, a second embodiment will be described with reference to FIG. 5.

Further, the learning of the second embodiment is set based on the valve closing learning that learns the individual difference of the fuel injector from the valve closing behavior of the valve body. From above, FIG. 5 illustrates a valve closing learning permission flag (501) which determines whether to learn the valve closing behavior of the fuel injector, a valve closing learning prohibition flag (502) which determines whether to prohibit the valve closing learning execution, a valve closing learning completion flag (503) which determines whether the valve closing learning is completed, and an internal combustion engine rotation speed (504).

At T505, the internal combustion engine is started and the internal combustion engine rotation speed (504) increases. Then, at the time point of T506, a predetermined valve closing permission condition is established and the valve closing learning permission flag (501) is turned on. In this embodiment, a period (501*a* in FIG. 5) from T506 to T509 in which the valve closing learning permission flag (501) is turned off is set as a period of monitoring whether to prohibit the valve closing learning. Here, it is desirable that the valve closing learning prohibition condition include a plurality of conditions illustrating a state where a factor causing the valve body behavior of the fuel injector to be unstable cannot be eliminated or reduced.

Further, a learning process is executed on the basis of the predetermined learning procedure described in FIG. 3 during a period in which the valve closing learning permission flag (501) is turned on and the valve closing learning prohibition flag (501) is turned off. In the drawings, this period corresponds to a period from T507 to T508.

Further, in this embodiment, since the valve closing learning prohibition condition is established at T508, the learning is not resumed even when the valve closing learning permission flag is maintained in an on state even after T508.

Meanwhile, at T509, the valve closing learning condition is not established and the valve closing learning permission flag (501) is turned off. Then, at T510, the valve closing learning condition is established again and the valve closing learning permission flag (501) is turned on. Accordingly, the valve closing learning prohibition state is released and the predetermined valve closing learning prohibition condition is monitored again.

Further, regarding the monitoring of the valve closing learning prohibition condition, a period (502*a*) from the time point (T507) in which the valve closing learning prohibition flag (502) is turned off to T509 in which the valve closing learning permission flag (501) is turned off other than 501*a* may be set as a monitoring period. Here, in this case, the valve closing learning execution or start condition needs to be provided separately.

Next, another method of the second embodiment will be described with reference to FIG. 6. That is, the control device (ECM) of this embodiment prohibits the learning of the valve closing timing using the learning unit when a predetermined condition is established. The predetermined condition is set to a time until the internal combustion engine is prohibited or the supply of the power to the internal combustion engine control device is prohibited from a time point in which at least one of the conditions is satisfied, that is, a predetermined learning procedure ends after the internal combustion engine is started or a correction based on the learning information obtained by the learning ends after the learning ends.

Figure 5:
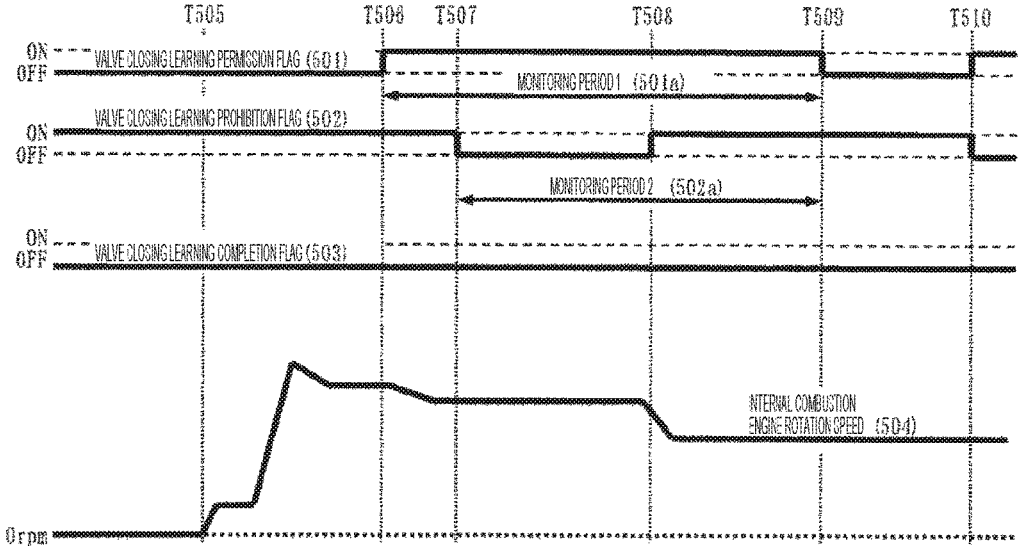
FIG. 5 is an embodiment of the invention.
Figure 6:
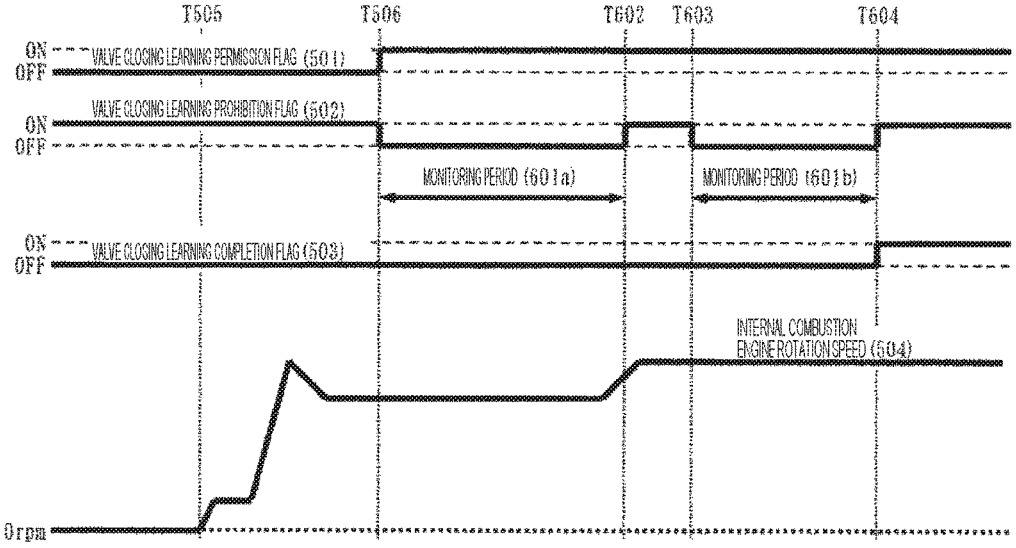
FIG. 6 is an embodiment of the invention.

FIG. 6 is very similar to FIG. 5, but since the period of monitoring the valve closing learning prohibition condition is set as a period 601*a* from T506 in which the valve closing learning permission flag (501) is turned on to T602 in which the valve closing learning prohibition flag (502) is turned on, a learning method may be different from that of FIG. 5.

Specifically, since the period of monitoring the valve closing learning prohibition condition is set as 601*a*, the valve closing learning prohibition flag (502) is turned on when the learning prohibition condition is established at T602. However, since the valve closing learning permission flag (501) is maintained in an on state, when the valve closing learning prohibition condition is not established, the valve closing learning prohibition flag (502) is turned off again and the valve closing learning is resumed (in the drawing, T603). However, as a matter of course, the period of monitoring the valve closing learning prohibition condition is newly set (601*b*) by resuming the valve closing learning.

Next, the valve closing learning completion flag (503) is turned on at T604 in which the valve closing learning completes a predetermined learning procedure. Here, since the valve closing learning prohibition condition is set when the valve closing learning completion flag (603) is turned on, the valve closing learning prohibition flag (502) is turned on and the subsequent learning is not executed again, for example, until the internal combustion engine is stopped or the supply of the power to the internal combustion engine control device is stopped.

Accordingly, a procedure of executing one-time learning whenever starting the internal combustion engine is established.

Third Embodiment

Next, a third embodiment will be described with reference to FIG. 7.

Figure 7:
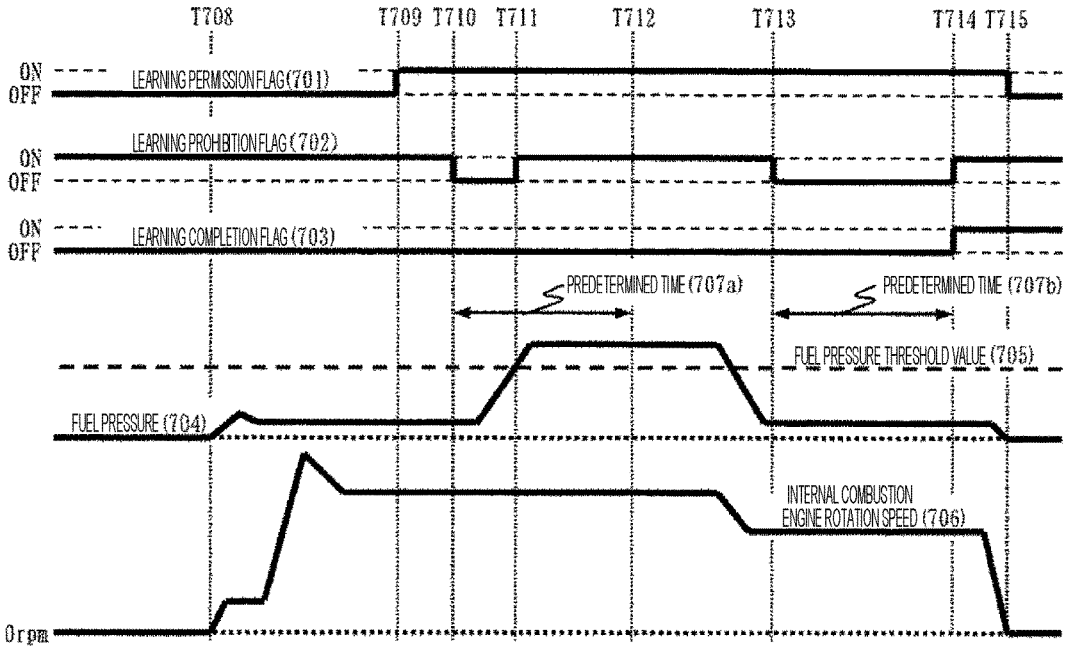
FIG. 7 is an embodiment of the invention.

From above, FIG. 7 illustrates a learning permission flag (701), a learning prohibition flag (702), a learning completion flag (703), a fuel pressure (704) inside a common rail provided at the upstream side of the fuel injector, and an internal combustion engine rotation speed (705). Here, the internal combustion engine is started at T708, the learning permission flag (701) is turned on at T709, and the learning is permitted at T710 in which the learning prohibition condition is not established.

The fuel pressure (704) is monitored for a predetermined time (707*a*) from a time point (T710) in which the learning is permitted and the learning prohibition flag is turned on at a time point (T711) in which the fuel pressure (704) becomes the predetermined fuel pressure threshold value (705) or more so that the learning process is prohibited.

Next, when the learning start condition or the like is established again, the learning prohibition flag is turned off (T713) and the fuel pressure (704) is monitored again for a predetermined time (707*b*) at T713 as a starting point.

Next, since the fuel pressure (704) does not become the fuel pressure threshold value (705) or more, the learning is completed at T714 and the learning completion flag (703) is turned on. Accordingly, the learning prohibition flag (702) is also turned on. In addition, since the learning permission flag (701) is cleared at T715 in which the internal combustion engine is stopped, one learning process can be executed during the operation of the internal combustion engine.

Here, regarding the predetermined time (707), for example, the number of times of learning for each cylinder and the internal combustion engine rotation speed are converted into unit time and are multiplied by the number of cylinders to obtain a learning consumption time. Thus, it is desirable to set a monitoring time by using the learning consumption time as the predetermined time. However, a predetermined value may be simply used from a learning start time point (T710 or T713).

Next, a learning prohibition method different from FIG. 7 will be described with reference to FIG. 8. That is, the control device (ECM) of this embodiment prohibits the learning of the valve closing timing using the learning unit when a predetermined condition is established. Then, as the predetermined condition, the predetermined condition is set to a case where a difference between information obtained during the learning and predetermined information stored at the learning start time point becomes a predetermined range or more.

Figure 8:
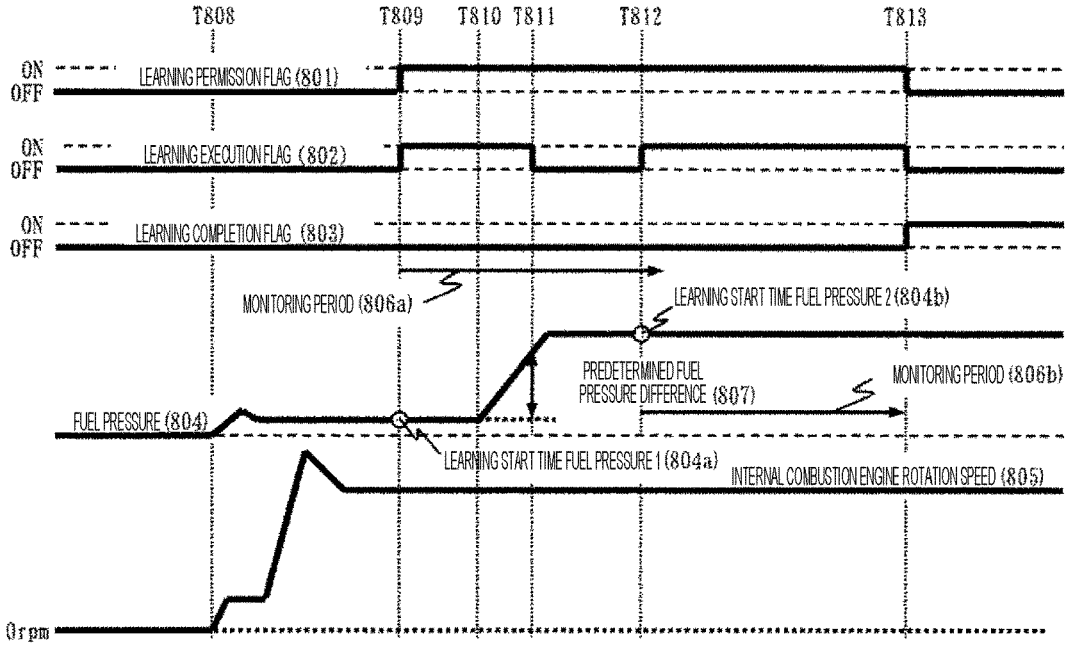
FIG. 8 is an embodiment of the invention.

From above, FIG. 8 illustrates a learning permission flag (801), a learning execution flag (802), a learning completion flag (803), a fuel pressure (804) inside a common rail provided at the upstream side of the fuel injector, and an internal combustion engine rotation speed (705). Since the learning execution condition is also established at a time point in which the internal combustion engine is started at T808 and the learning permission flag (801) is turned on at T809, the learning execution flag (802) is also turned on.

Here, a fuel pressure (804*a*) at the time point (T809) in which the learning execution flag (802) is turned on is stored and a period (806*a*) of monitoring the behavior of the fuel pressure (804) is started. The fuel pressure (804) of the drawing starts to increase at T810, but since the fuel pressure (804) becomes a value equal to or larger than a predetermined fuel pressure difference (807) at T811, the learning execution flag (802) is turned off and the learning process is prohibited.

Next, since the learning execution condition is established again at T812 so that the learning execution flag (802) is turned on, the learning process is executed. Then, the learning start time fuel pressure (804*b*) is stored and the period (806*a*) of monitoring the behavior of the fuel pressure (804) is started. However, a change amount of the fuel pressure (804) does not become the predetermined fuel pressure difference (807) or more and the learning completion flag (803) is turned on since the learning process is completed at T812.

Accordingly, the learning execution flag (802) and the learning permission (801) are turned off and one learning process can be executed during the operation of the internal combustion engine.

Next, the learning execution condition will be described with reference to FIG. 9. The learning permission condition is a condition of allowing the learning and the learning execution condition is set as a condition of prohibiting or interrupting the learning in order to prevent an erroneous learning. The erroneous learning is mainly caused by poor reproducibility of the operation of the valve body provided in the fuel injector (108). Specifically, although a description has been made in FIG. 9, FIG. 9 illustrates a pulse signal (901) indicating the operation period of the fuel injector (108), a valve body behavior A (902) having poor reproducibility, and an ideal valve body behavior B (903) from above.

In addition, the predetermined information indicates a state where the valve body behavior of the fuel injector changes every injection operation and includes at least one or more of a power voltage, a driving current waveform, and a temperature of the fuel injector, a water temperature, an oil temperature, a fuel temperature, an intake air temperature, a rotation speed, a load, and a pulse signal width of the internal combustion engine, a fuel injection start timing, a fuel injection completion timing, and an oil temperature of a vehicle driving system to be recognized by the control device.

Since the pulse signal (901) is turned on at T906, the valve body behavior A (902) starts the valve opening operation. Here, a time in which the valve body reaches the full lift position is set as a valve opening timing (904) and the valve body behavior A (902) continues a bouncing state in the vicinity of the full lift position. Next, since the pulse signal (901) is turned off at T907, the valve body behavior A (902) starts the valve closing operation and reaches the valve closing position at last. A time point in which the valve body reaches the valve closing position is set as a valve closing timing (905). In this learning, a time (904*a*) until a time point in which the valve body reaches the full lift position after the pulse signal (901) is turned on is defined as a valve opening time and a time (905*a*) until a time point in which the valve body reaches the valve closing position after the pulse signal (901) is turned off is defined as a valve closing time. Then, these times are checked.

Figure 9:
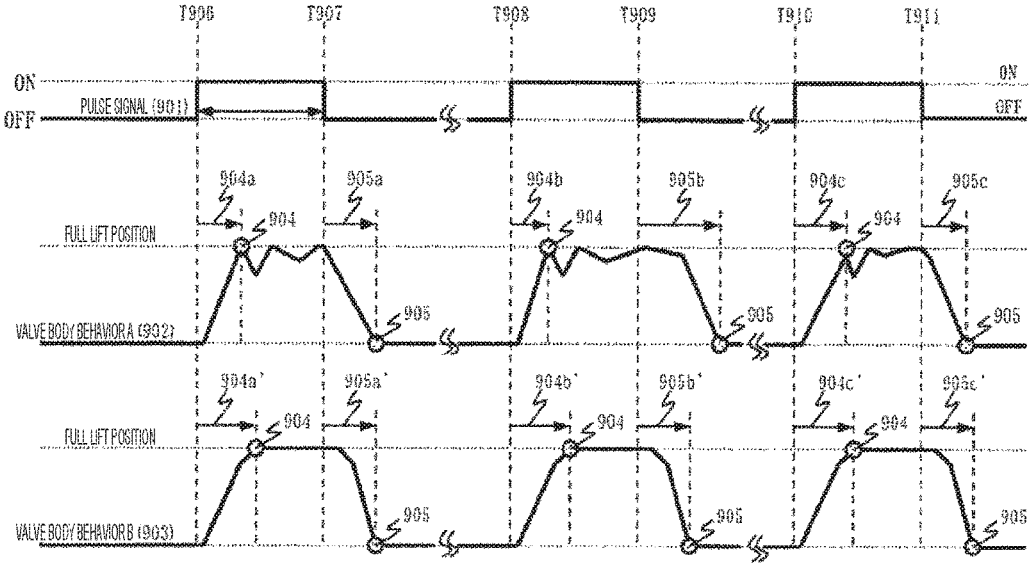
FIG. 9 is an explanatory diagram of a valve body behavior.

The pulse signal (901) of FIG. 9 is turned on and off three times totally along with T908-T909 and T910-T911 and although the pulse signal widths are the same, the valve opening times (904*a*, 904*b*, 904*c*) are different. Similarly, since the valve closing times (905*a*, 905*b*, 905*c*) also have a difference, a different time is checked for each operation even when the learning is executed in this state. For this reason, there is a possibility of the erroneous learning.

Here, for example, when the driving current profile of the fuel injector (108) is set as a dedicated learning waveform, the valve opening time (904*a*', 904*b*', 904*c*') or the valve closing time (905*a*', 905*b*', 905*c*') needs to be maintained with high reproducibility similarly to the valve body behavior B (903).

For this reason, in this embodiment, a factor which causes the unstable valve body behavior is eliminated or reduced to execute the learning from the state similar to the valve body behavior B (903) and the learning is prohibited or interrupted when there is concern that a different learned value can be checked for each operation similarly to the valve body behavior A (902).

As a change factor of the valve behavior, a factor causing a change in electric characteristic from a change in temperature characteristic of the fuel injector (108) is exemplified. For this reason, a unit of directly checking a resistance or an inductance of the fuel injector (108) is desirable. However, since the fuel injector (108) or the fuel injector driving circuit increases in cost, electric characteristics are estimated from the temperature of the fuel injector (108).

Here, a unit of directly checking the temperature of the fuel injector (108) may be used, but since there is a little large divergence between the water temperature, the oil temperature, or the fuel temperature of the internal combustion engine, and the temperature of the fuel injector (108), the prohibition or the interruption of the learning may be determined by using these temperatures.

Here, it is desirable that a temperature measurement position be located at a position close to the fuel injector (108) when the fuel temperature is measured. Further, although the accuracy is worse than in the case of using the above-described temperature, a method of estimating electric characteristics from the oil temperature of the driving system can be used.

In addition, as the factor of changing the valve behavior, the driving current of the fuel injector (108) becomes different every operation due to a change in the power voltage (the battery voltage (110) and the high voltage (109)) of the fuel injector. For this reason, there is a need to consider an influence on a change in the valve body behavior. For this reason, in this embodiment, the learning is prohibited or interrupted when the driving current or the power voltage behavior of the fuel injector (108) is out of a predetermined range.

Similarly, when the pulse signal width indicating the driving period of the fuel injection valve (108) is a predetermined value or less, a magnetic force at the beginning of the valve opening operation using the high voltage (109) is weakened. Accordingly, there is a possibility that the valve body behavior becomes unstable along with the pulsation of the fuel pressure. For this reason, in this embodiment, since a method of directly monitoring the pulse width and a method of estimating the pulse width from the rotation speed or the load of the internal combustion engine can be executed, the prohibition or the interruption of the learning may be determined by using these methods.

In addition, an influence of a cylinder internal pressure is exemplified as the factor of changing the valve body behavior of the fuel injector (108).

Since the cylinder internal pressure applies a force of opening the valve while the fuel pressure inside the fuel injector (108) applies a force of closing the valve body, it is desirable that the fuel injection timings be close to each other at the time of learning the fuel injector (108) of the same cylinder. For this reason, this embodiment has a feature that the prohibition or the interruption of the learning is determined at the fuel injection start/end timing.

As described above, the fuel injector control device that controls the plurality of fuel injectors of this embodiment includes the learning unit that leans the valve closing timing of the fuel injector on the basis of the driving voltage applied to the fuel injector or the driving current flowing to the fuel injector and when a predetermined condition is established, the learning of the valve closing timing using the learning unit is prohibited. Then, the predetermined condition indicates a state where the valve body behavior of the fuel injector changes every injection operation and is set to a case where the driving current waveform of the fuel injector does not become a predetermined waveform, a case where one or more of the power voltage and the temperature of the fuel injector; the water temperature, the oil temperature, the fuel temperature, the intake air temperature, the rotation speed, the load, and the pulse signal width of the internal combustion engine; and the oil temperature of the vehicle driving system become a predetermined value or less or out of a predetermined range, or a case where at least one or more of the fuel injection start timing and the fuel injection completion timing are out of a predetermined range to be recognized by the control device.

Next, a method of prohibiting or interrupting the learning in the control device of the internal combustion engine capable of injecting a fuel in multiple stages will be described with reference to FIG. 10.

Figure 10:
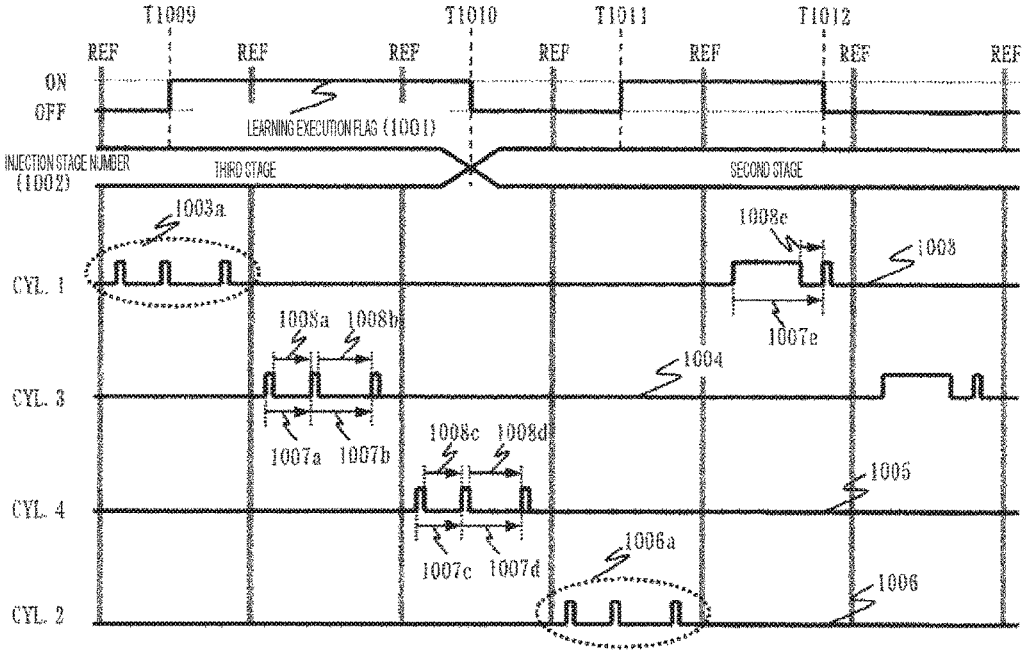
FIG. 10 is a multi-stage injection control device of an embodiment of the invention.

From above, FIG. 10 illustrates a learning execution flag (1001), a required injection stage number (1002), and pulse signals (CYL. 1:1003, CYL. 3:1004, CYL.4:1005, CYL. 2:1006) of cylinders. In this embodiment, the learning execution flag (1001) is turned on at T1009 to execute the learning, but the required injection stage number (1002) changes from a third stage injection to a second stage injection at T1010 to interrupt or prohibit the learning.

This is because the injection timing changes due to a change in the required injection stage number (1002). As described above, there is concern that the valve body behavior of the fuel injector (108) may be changed.

Further, since the learning execution flag (1001) is turned on at T1009, the third stage injection (1003*a*) of the pulse signal (1003) of CYL. 1 previously executing the injection does not correspond to the learning monitoring target and the operation of the fuel injector (108) corresponding to the learning execution determination target starts from CYL. 3 at earliest.

Here, in this embodiment, when a time interval (1007*a* or 1007*b*) from the precedent injection start to the subsequent injection start becomes a predetermined value or less or a time interval (1008*a* or 1008*b*) from the precedent injection end to the subsequent injection start becomes a predetermined value or less, the learning is prohibited or interrupted.

Regarding the time interval (1007*a* or 1007*b*) from the precedent injection start to the subsequent injection start, since the high voltage (109) is consumed by the precedent injection, the valve body behavior becomes unstable due to the lack of the high voltage (109) when the injection operation is executed before a voltage value returns to a predetermined high voltage value until the subsequent injection.

Regarding the time interval (1008*a* or 1008*b*) until the subsequent injection start, the valve closing time cannot be measured when the subsequent injection operation is executed before the valve body becomes a complete valve closing state. Although this is natural, in this case, a large change occurs in the valve opening time of the subsequent injection.

When the learning is continued, the time interval (1007*c*, 1007*d*, 1008*c*, 1008*d*) is monitored in the same way also in CYL. 4 after the monitoring of CYL. 3 ends. However, this only illustrates an example of the cylinder to be monitored and the cylinder to be monitored during the learning execution may be determined on the basis of the predetermined learning procedure.

Next, the learning execution flag (1001) is turned on again at T1011. However, the injection operation (1006*a*) of CYL. 2 already executing the injection operation does not correspond to the monitoring target and CYL. 1 which is the next cylinder at earliest corresponds to the monitoring cylinder.

Here, although the injection stage number is a second stage, the time interval (1007*e*) from the precedent injection start to the subsequent injection start and the time interval (1008*e*) from the precedent injection end to the subsequent injection start are basically the same as those described above except for two time intervals are changed to one time interval. In this drawing, when the time interval of 1007*e* or 1008*e* becomes a predetermined value or less, the learning execution flag (1001) is turned off at T1012 and the learning is prohibited or interrupted.

Figure 11:
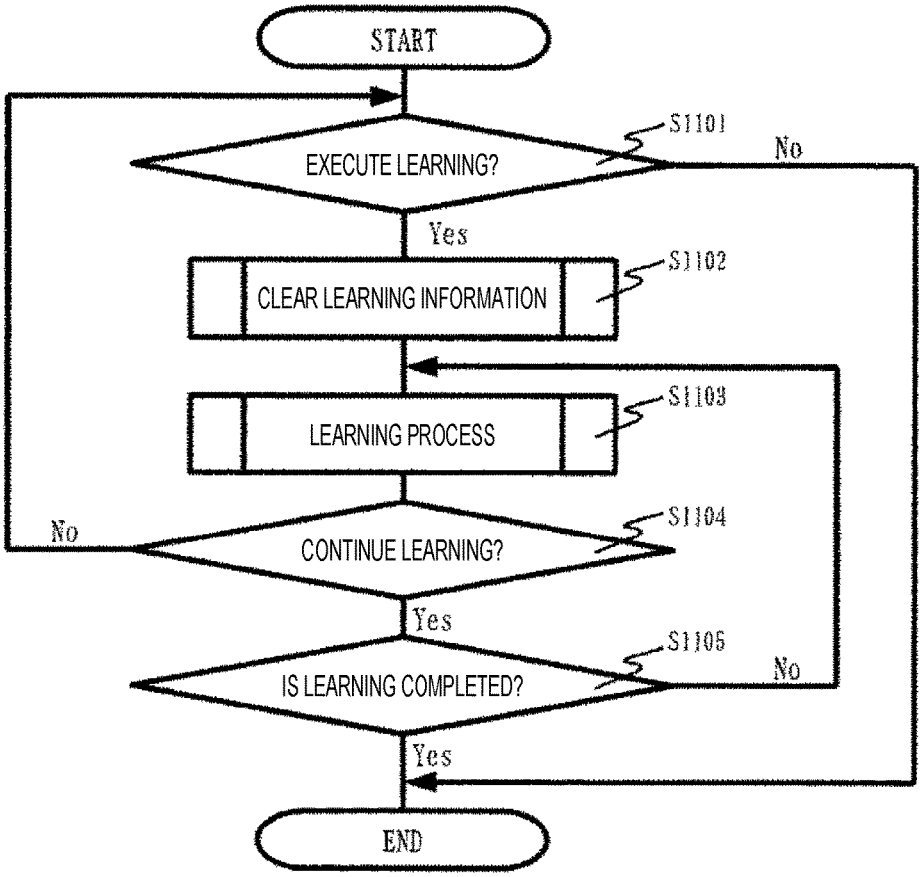
FIG. 11 is a first flowchart of the invention.

Next, a procedure of resuming the learning after stopping the learning of this embodiment will be described with reference to FIG. 11. First, although it is determined whether to execute the learning in S1101, this determination will be omitted since the determination has been described above. When it is determined to execute the learning, the routine proceeds to S1102. Meanwhile, when it is determined to prohibit or interrupt the learning, the routine ends without executing anything.

The learning information is cleared (initialized) in S1102 and the learning process described in FIG. 3 is executed in S1103. Here, after one learning process (that is, the valve opening learning information or the valve closing learning information is obtained once) is executed in S1103, the routine proceeds to S1104 to determine whether to continue the learning. The condition of S1104 is determined based on whether the operation of the valve body of the fuel injector (108) changes, but may include other conditions with the learning permission flag.

When the learning is continued, the routine proceeds to S1105 to determine whether the learning is completed or not. When it is determined that the learning is not continued, that is, the learning is prohibited or interrupted, the routine proceeds to S1101 to determine whether to execute the learning. In S1105, it is determined whether all learning information to be obtained is obtained on the basis of the predetermined learning procedure and the number of times of learning. However, when the learning does not end, the routine proceeds to S1103 to obtain the learning information by the predetermined learning procedure.

When a predetermined number of times of learning is completed, the learning ends in this drawing, but there is a case where the learning completion flag is turned on as illustrated in the other drawings. As the feature of the drawing, the process in S1102 can be exemplified. Here, when the learning execution is permitted again after the learning is interrupted or prohibited (when the condition of S1004 is not established), all information obtained so far by the learning process is discarded and the learning information is obtained again from the beginning according to the learning procedure. This is an effective method for a case in reobtaining the information where there is no guarantee that the information learned so far and the information to be learned from now on can be obtained on the same condition.

Figure 12:
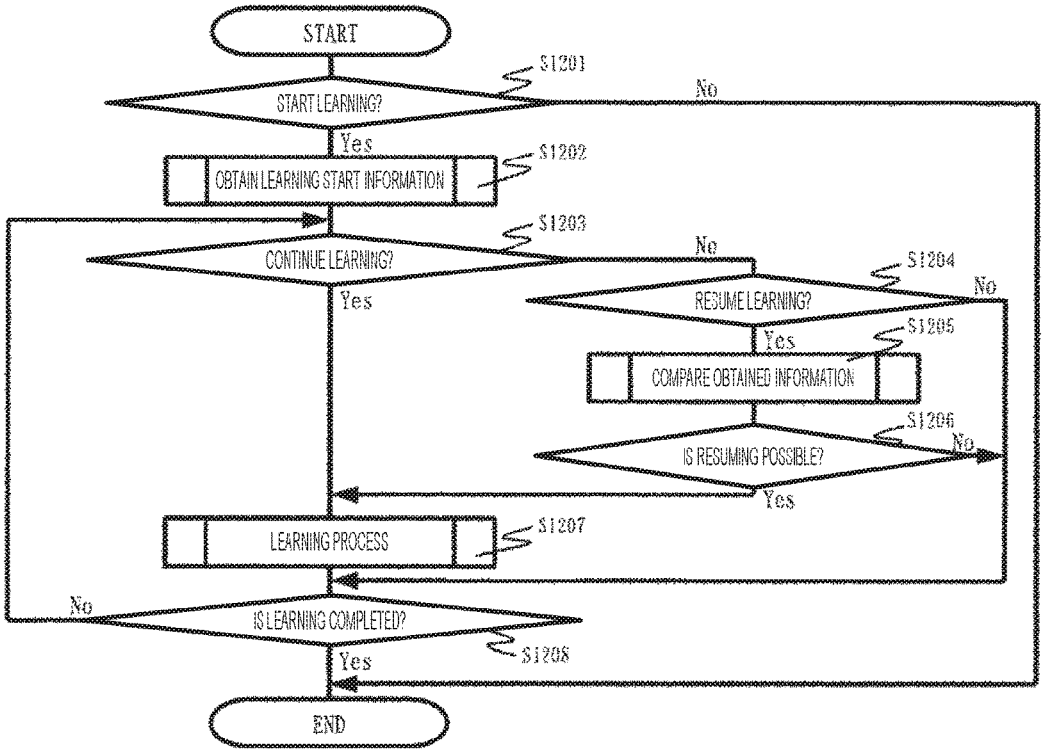
FIG. 12 is a second flowchart of the invention.

Next, another procedure of resuming the learning will be described with reference to FIG. 12.

First, it is determined whether to start the learning in S1201 (similarly to S1101). When the condition is established, the routine proceeds to S1102. Meanwhile, when the condition is not established, the routine ends without executing anything. In S1102, predetermined information (for example, parameters or the like described in FIG. 9) at the time point in which the learning is started first is obtained and stored. Next, the routine proceeds to S1203 to determine whether to continue the learning. When the condition is established, the routine proceeds to S1207. Meanwhile, when the condition is not established, the routine proceeds to S1204. In S1207, one learning information item is obtained similarly to S1103 and the routine proceeds to S1208. In S1208, it is determined whether the learning is completed similarly to S1105. When the condition is established, the routine ends. Here, there is a case where the learning completion flag is turned on as in the other drawings. When the condition is not established, the routine returns to S1203. When it is determined in S1203 that the condition is not established, that is, the learning is prohibited or interrupted, it is determined in S1204 whether to resume the learning, but the condition as that of S1201 may not exist herein.

When the condition is established in S1204, the routine proceeds to S1305. Meanwhile, when the condition is not established, the routine proceeds to S1208. In S1305, the information same as that obtained in S1202 is obtained again at the time point in which the condition of S1204 is established. In S1306, when it is determined that the information obtained in S1202 and the information obtained in S1305 are within a predetermined range, that is, the same condition as a result of comparison, the routine proceeds to S1207 to resume the obtaining from the time point in which the learning is interrupted or prohibited.

In this case, since it is possible to recognize the current position of the predetermined learning procedure, there is an advantage that the time necessary for resuming the learning can be decreased while using the information obtained before the interruption or the prohibition of the learning process.

Further, since the routine proceeds to S1208 in this drawing when the condition is not established at S1206, the learning is not executed until the condition of S1206 is established. However, when the condition of S1206 is not established, the routine may be started from S1102 of FIG. 11. In this way, since the learning is started again from the beginning when the condition of S1206 is not established, it is possible to prevent less learning opportunities.

Fourth Embodiment

Next, a fourth embodiment of the invention will be described with reference to FIG. 13.

In this drawing, the learning interruption/stop condition and the relearning condition based on the learning interruption (stop) region (1307*a*, 1307*b*) according to the fuel pressure will be described.

Figure 13:
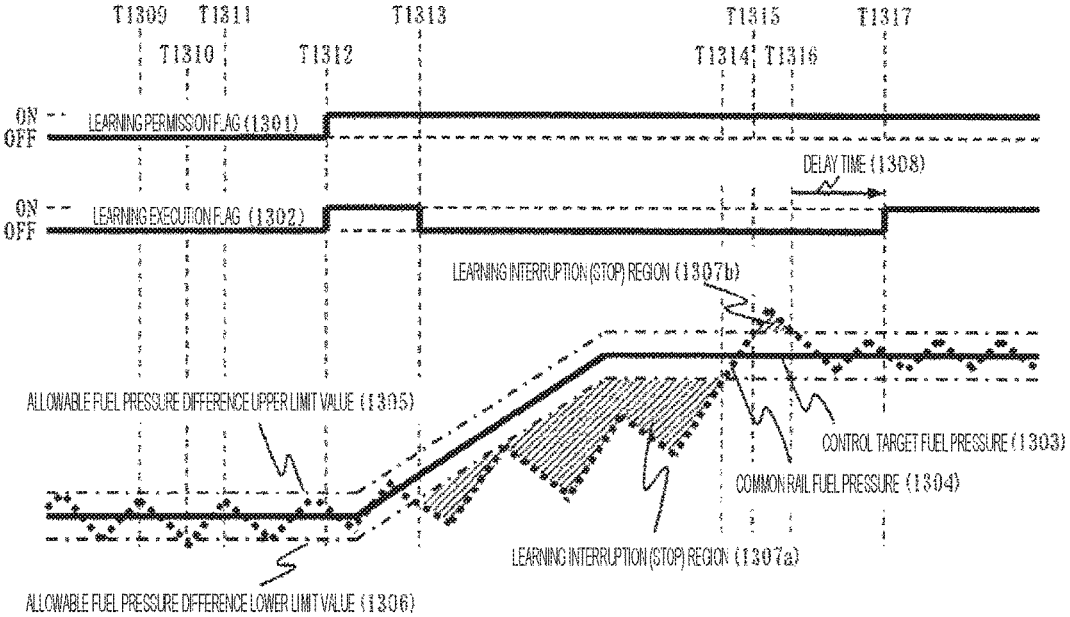
FIG. 13 is an embodiment of the invention.

From above, FIG. 13 illustrates a learning permission flag (1301) and a learning execution flag (1302). Then, a lower solid line indicates a control target fuel pressure (1303), a dashed line indicates a common rail fuel pressure (1304), and one-dotted chain lines indicate an upper limit value (1305) and a lower limit value (1306) of an allowable fuel pressure difference.

Since the control target fuel pressure (1303) is a control target value set from a rotation speed or a load of an internal combustion engine, or a combustion mode (a stratified combustion, a homogeneous combustion, an ignition retard, or the like), the control target fuel pressure indicates a constant value under the same condition as in FIG. 13. Then, when the condition changes, the control target fuel pressure changes in a ramp shape in FIG. 13, but changes in a step shape in some cases.

Here, in the invention, the control target fuel pressure (1303) at the time point (T1312) in which the learning starts is stored and the learning is interrupted or prohibited when a difference between the stored pressure and the recent control target fuel pressure (1303) becomes a predetermined value or more.

Meanwhile, since the common rail fuel pressure (1304) corresponding to the actual fuel pressure increases due to the fuel discharged from the high pressure fuel pump (not illustrated) (T1310 to T1311) and decreases when the fuel is injected from the fuel injector (108) (T1309 to T1310), pulsation characteristics are obtained as in the drawings.

Here, in this embodiment, the learning process is prohibited or interrupted when the common rail fuel pressure (1304) is deviated from the upper limit value (1305) and the lower limit value (1306) of the allowable fuel pressure difference corresponding to a predetermined range on the basis of the control target fuel pressure (1303).

In the drawing, the learning permission flag (1301) is turned on and the learning execution flag (1302) is also turned on at T1312. However, the control target fuel pressure (1303) increases after a while from T1312 and the common rail fuel pressure (1304) also increases to follow such an increase in the control target fuel pressure. However, since the common rail fuel pressure (1304) is lower than the lower limit value (1306) of the allowable fuel pressure difference for a temporary time (T1313 to T1314) due to the above-described pulsation characteristics, the learning execution flag (1302) is turned off at T1313 to prohibit or interrupt the learning process.

Next, the common rail fuel pressure (1304) first falls within the range of the lower limit value (1306) of the allowable fuel pressure difference in T1314, but exceeds the upper limit value (1305) of the allowable fuel pressure difference again at T1315 due to the above-described pulsation characteristics.

For this reason, when the fuel pressure is used in the learning resume condition (S1101, S1104, S1201, S1203, S1204), it is desirable to ensure a predetermined delay time (1308) after the common rail fuel pressure (1304) falls within the upper limit value (1305) of the allowable fuel pressure difference and the lower limit value (1306) of the allowable fuel pressure difference.

In FIG. 13, the common rail fuel pressure (1304) falls within the upper limit value (1305) of the allowable fuel pressure difference at T1316 and then the learning is resumed from T1317 elapsed therefrom by the predetermined delay time (1308).

Fifth Embodiment

Next, a fifth embodiment will be described with reference to FIG. 14.

Figure 14:
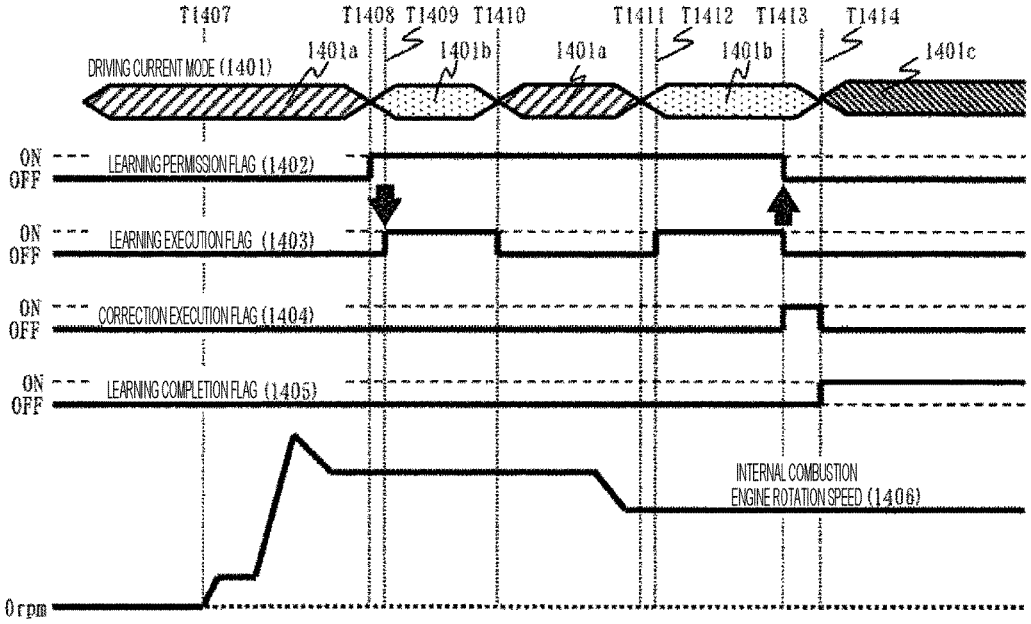
FIG. 14 is an embodiment of the invention.

From above, FIG. 14 illustrates a driving current mode (1401), a learning permission flag (1402), a learning execution flag (1403), a correction execution flag (1404), a learning completion flag (1405), and an internal combustion engine rotation speed (1406) which are obtained as a result of selecting the predetermined driving current profiles of one or more fuel injectors (108).

First, the internal combustion engine is started at T1407 so that the internal combustion engine rotation speed increases. At this time, the driving current mode is a driving waveform (1401*a*) which is commonly used for all cylinders from the past and indicates the driving waveform corresponding to the valve body behavior A (902) inside FIG. 9. Next, the learning permission flag (1402) is turned on at T1408 so that the driving current mode is changed. Here, the driving current mode indicates the learning waveform, but the learning waveform mentioned herein indicates the waveform of which the bouncing of the valve body is reduced similarly to the valve body behavior B (903) of FIG. 9. At the time point (T1409) in which the driving waveform mode (1401) is recognized as a learning driving waveform (1401*b*), the learning execution flag (1402) is turned on to execute the learning process. Next, when it is determined that the learning cannot be continued at T1410, the learning execution flag (1402) is turned off so that the learning is interrupted or prohibited. However, at this time, the driving waveform mode (1401) returns to the driving waveform (1401*a*) used from the past. Next, when it is determined to resume the learning at T1411, the driving waveform mode (1401) becomes the learning driving waveform (1401*b*). Then, at T1412 in which the above-described waveform is obtained, the learning execution flag (1402) is turned on to resume the learning.

At T1413, all learning processes described in FIG. 3 are completed and the learning execution flag (1403) is turned off. Thus, the learning permission flag (1402) is also turned off. At the same timing, the correction execution flag (1404) is turned on and the injection pulse width or the driving current of the fuel injector (108) is corrected for each cylinder on the basis of the learning information. When the correction process is completed at T1414, the correction execution flag (1404) is turned off and the learning completion flag (1405) is turned on.

Further, when the correction process is completed, the driving current mode (1401) becomes the correction driving waveform (1401*c*) for each cylinder and the half lift control is permitted. Even when the fuel injector (108) is replaced in the market according to this procedure, the half lift control can be used without deteriorating the exhaust performance of the internal combustion engine and deterioration in the fuel injector (108) can be also detected.

As described above, in this embodiment, the driving current or the driving time of the fuel injector is corrected for each fuel injector on the basis of the learning information obtained by the learning after all learning procedures are completed.

Further, a configuration of each flag (1402 to 1405) is an example and a method of obtaining the effect of this embodiment is not limited thereto. Further, FIG. 14 illustrates an effect which can be obtained by this embodiment. For example, when a forced learning is assumed at the time of replacing the fuel injector (108), the correction driving waveform (1401*c*) for each cylinder can be used from the time before the start of the internal combustion engine.

REFERENCE SIGNS LIST

401 learning permission flag
402 learning execution flag
403 learning completion flag
404 internal combustion engine rotation speed
T405 internal combustion engine start timing
T406 learning permission and learning execution timing
T407 learning interruption timing
T408 learning resume timing
T409 learning completion timing
T410 internal combustion engine stop timing

The invention claimed is:

1. A control system comprising:

a fuel injector control device configured to control a plurality of fuel injectors, the fuel injector control device comprising:

a control unit that detects a valve opening/closing timing of the fuel injector; and a learning unit that learns the valve opening/closing timing of the fuel injector on the basis of a driving voltage applied to the fuel injector or a driving current flowing to the fuel injector, wherein the learning of the valve opening/closing timing of the fuel injector using the learning unit is prohibited if a predetermined condition is established, the predetermined condition being associated with an operation of an internal combustion engine, and the predetermined condition is set to at least one of a time until the internal combustion engine is prohibited and a supply of power to an internal combustion engine control device is prohibited from a time point in which any one of conditions is established, that is, a predetermined learning procedure ends after the internal combustion engine starts, and a correction based on learning information obtained by the learning ends.

2. The control system according to claim 1, wherein when the valve opening/closing timing of the fuel injector is learned by the learning unit, the learning is prohibited if the predetermined condition is established.

3. The control system according to claim 1, wherein the learning of the valve opening/closing timing of the fuel injector using the learning unit is prohibited if a fuel pressure of a common rail supplying a fuel to the plurality of fuel injectors changes by a predetermined value or more within a predetermined time.

4. The control system according to claim 1, wherein the predetermined condition indicates a case where a difference between information obtained during the learning and predetermined information stored at a time point of starting the learning becomes a predetermined range or more, wherein the predetermined range is greater than zero.

5. The control system according to claim 4, wherein the predetermined information indicates a state where a valve body behavior of the fuel injector changes every injection operation and includes at least one or more of a power voltage, a driving current waveform, and a temperature of the fuel injector, a water temperature, an oil temperature, a fuel temperature, an intake air temperature, a rotation speed, a load, and a pulse signal width of the internal combustion engine, a fuel injection start timing, a fuel injection completion timing, and an oil temperature of a vehicle driving system to be recognized by the control device.

6. The control system according to claim 5, wherein a multi-stage injection control of injecting a fuel multiple times during one combustion cycle is executable and the predetermined information includes at least one or more of a case where the injection stage number is changed, a case where a time interval from a precedent injection start to a subsequent injection start becomes a given value, and a case where a time interval from a precedent injection end to a subsequent injection start becomes the given value in addition to the information of claim 5, wherein the given value is greater than zero.

7. The control system according to claim 3, wherein the predetermined condition indicates a state where a valve body behavior of the fuel injector changes every injection operation and includes a case where a driving current waveform of the fuel injector does not become a predetermined waveform, a case where one or more of a power voltage and a temperature of the fuel injector, a water temperature, an oil temperature, a fuel temperature, an intake air temperature, a rotation speed, a load, and a pulse signal width of the internal combustion engine, and an oil temperature of a vehicle driving system becomes a given value or out of a predetermined range, and a case where at least one of a fuel injection start timing and a fuel injection completion timing becomes out of a predetermined range to be recognized by the control device, wherein the given value is greater than zero.

8. The control system according to claim 7, wherein a multi-stage injection control of injecting a fuel multiple times during one combustion cycle is executable and the predetermined information includes at least one or more of a case where the injection stage number is changed, a case where a time interval from a precedent injection start to a subsequent injection start becomes a given value, and a case where a time interval from a precedent injection end to a subsequent injection start becomes the given value in addition to the information of claim 7, wherein the given value is greater than zero.

9. The control system according to claim 8, wherein when the learning is started again after the learning is interrupted, all learning information obtained before the interruption is discarded and a predetermined learning procedure is executed from the beginning.

10. The control system according to claim 9, further comprising:

a learning start time information storage unit that stores predetermined information at the time of starting the learning, wherein information of the learning start time condition storage unit is compared with recent predetermined information when the learning is started again after the learning is interrupted, and if it is determined that both information items are within a predetermined range, a learned value obtained before the interruption of the learning is used and the learning process is resumed from a time point in which the learning is interrupted in a predetermined learning procedure.

11. The control system according to claim 3, further comprising:

a desired fuel pressure control unit, wherein a control target fuel pressure at a time point in which the learning is started is stored and when a difference between the stored control target fuel pressure and a control target fuel pressure during the learning becomes a given value, the learning is interrupted or prohibited, wherein the given value is greater than zero.

12. The control system according to claim 3, further comprising:

a desired fuel pressure control unit, wherein when a difference between a control target fuel pressure during the learning and a fuel pressure of a common rail supplying a fuel to the plurality of fuel injectors becomes a given value, the learning of the valve opening/closing timing of the fuel injector using the learning unit is prohibited, wherein the given value is greater than zero.

13. The control system according to claim 1, wherein the driving current or the driving time of the fuel injector is corrected for each fuel injector on the basis of a learned value obtained by the learning after a learning procedure is completed.

14. The control system according to claim 2, wherein the predetermined condition is set to a time until the internal combustion engine is prohibited or a supply of power to an internal combustion engine control device is prohibited from a time point in which any one of conditions is established, that is, a predetermined learning procedure ends after the internal combustion engine starts or a correction based on learning information obtained by the learning ends.

15. The control system according to claim 3, further comprising:

a desired fuel pressure control unit, wherein a control target fuel pressure at a time point in which the learning is started is stored and when a difference between the stored control target fuel pressure and a control target fuel pressure during the learning becomes a given value, the learning is interrupted or prohibited, wherein the given value is greater than zero.

* * * * *